US007409738B2

(12) United States Patent
Borras et al.

(10) Patent No.: US 7,409,738 B2
(45) Date of Patent: Aug. 12, 2008

(54) SYSTEM AND METHOD FOR PREDICTING ROTATIONAL IMBALANCE

(75) Inventors: Rodrigo L. Borras, Marshalltown, IA (US); Michelle A. Clifford, Chandler, AZ (US); Leticia Gomez, San Diego, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 266 days.

(21) Appl. No.: 11/119,142

(22) Filed: Apr. 28, 2005

(65) Prior Publication Data

US 2006/0242769 A1 Nov. 2, 2006

(51) Int. Cl.
*D06F 33/02* (2006.01)

(52) U.S. Cl. ..... 8/159; 68/12.02; 68/12.06

(58) Field of Classification Search ..... 8/159; 68/12.02, 12.06
See application file for complete search history.

(56) References Cited

U.S. PATENT DOCUMENTS 3,382,724 A * 5/1968 Wilcox ..... 73/514.29
3,411,074 A * 11/1968 Ferdy ..... 324/207.25
3,678,493 A * 7/1972 Shuey ..... 340/529
4,060,002 A * 11/1977 Mortensen ..... 73/462
4,096,988 A * 6/1978 Scuricini ..... 494/7
4,098,098 A * 7/1978 Altnau ..... 68/23 R
4,342,025 A * 7/1982 Spalti et al. ..... 341/9
4,677,291 A * 6/1987 Ellingson ..... 250/213.1
4,744,249 A * 5/1988 Stewart ..... 73/504.04
4,752,898 A * 6/1988 Koenig ..... 356/400
4,855,042 A * 8/1989 Smith ..... 210/144
4,868,762 A * 9/1989 Grim et al. ..... 700/279
4,919,646 A * 4/1990 Perdriat ..... 494/1
5,269,159 A * 12/1993 Oh ..... 68/12.06
5,289,702 A * 3/1994 Murray ..... 68/23 R
5,345,829 A * 9/1994 Yamauchi et al. ..... 73/865.9
5,359,784 A * 11/1994 Tomida et al. ..... 33/550
5,406,846 A * 4/1995 Gasch et al. ..... 73/462

(Continued)

FOREIGN PATENT DOCUMENTS

GB 2 124 662 * 2/1984

(Continued)

OTHER PUBLICATIONS

European Patent Office 0 513 688 Nov. 1992.*

*Primary Examiner*—Frankie L Stinson
(74) *Attorney, Agent, or Firm*—Ingrassia, Fisher & Lorenz, P.C.

(57) ABSTRACT

A system and method is provided for predicting an imbalance condition in a rotating device. The rotational imbalance prediction system (100) includes an accelerometer assembly (104), including at least one accelerometer (304), and a processor (306). The at least one accelerometer (304) provides acceleration measurements to the processor (306), the measurements describing the current acceleration of an orbit of the rotational device (102). The processor (306) receives the acceleration measurements and calculates an average radius of the orbit (202) to determine if the average radius is increasing, predictive of an imbalance condition. The processor (306) generates a signal in response to the prediction of an imbalance condition and transmits the signal to a motor control (308) or a remote alarm module (302). The system and method provides for countermeasures to be taken in response to the prediction of an imbalance condition, thereby eliminating the imbalance condition.

17 Claims, 2 Drawing Sheets

U.S. PATENT DOCUMENTS

| | | | | |
|---|---|---|---|---|
| 5,485,678 | A * | 1/1996 | Wagg et al. | 33/610 |
| 5,659,136 | A * | 8/1997 | Koch et al. | 73/462 |
| 5,671,494 | A * | 9/1997 | Civanelli et al. | 8/159 |
| 5,713,221 | A * | 2/1998 | Myers et al. | 68/12.06 |
| 5,736,054 | A * | 4/1998 | Feller et al. | 210/739 |
| 6,032,494 | A * | 3/2000 | Tanigawa et al. | 68/12.06 |
| 6,507,799 | B2 * | 1/2003 | Steffen | 702/96 |
| 6,635,007 | B2 * | 10/2003 | Evans et al. | 494/7 |
| 6,654,975 | B2 * | 12/2003 | Broker | 8/159 |
| 6,764,437 | B2 * | 7/2004 | Tetsu et al. | 494/10 |
| 6,904,805 | B2 * | 6/2005 | Joseph et al. | 73/514.38 |
| 7,055,368 | B2 * | 6/2006 | Schneider et al. | 73/1.87 |
| 7,082,816 | B2 * | 8/2006 | Zhu | 73/146 |
| 7,219,036 | B2 * | 5/2007 | Abbotoy et al. | 702/183 |
| 2005/0204482 | A1 * | 9/2005 | Murray et al. | 8/158 |

FOREIGN PATENT DOCUMENTS

| | | | |
|---|---|---|---|
| JP | 61-290983 | * | 12/1986 |
| JP | 3-70596 | * | 3/1991 |
| JP | 3-86197 | * | 4/1991 |
| JP | 2003-71180 | * | 3/2003 |

* cited by examiner

SYSTEM AND METHOD FOR PREDICTING ROTATIONAL IMBALANCE

FIELD OF THE INVENTION

The present invention generally relates to the field of sensors, and more particularly to an improved system and method for predicting rotational imbalance in a device.

BACKGROUND OF THE INVENTION

Energy conservation is of great interest in the consumer electronics field, and in particular, in the field of home appliances. One of the best ways to conserve energy in home appliances is to reduce the ON-time of an appliance. One such appliance that is capable of a reduction in ON-time is a clothes dryer. The ON-time of a dryer can be directly correlated to the amount of water remaining in clothes being dried in the dryer. Washing machines, whether for home use or commercial use, include a spin cycle to extract water from the clothes being washed, prior to drying, thus reducing dryer ON-time, and increasing overall power conservation in home or commercial appliances To reduce dryer ON-time, consumers are requesting increased rotational speeds in today's washing machines due to the desire for less dryer ON-time. Faster spin rates can be used to wring more water out of clothing, making the drying process more efficient. One of the biggest problems however, with increasing the spin speed in a washer to promote further water extraction is the need for better imbalance detection and improved vibration control. If clothes undergoing the spin cycle are not balanced within the tub of the washer, an imbalance will occur and result in loud noises such as knocking when the inner tub hits the outer walls, increased vibration of the tub and overall machine body, and other detrimental conditions. In most instances, the spin cycle is stopped due to the imbalance and full water extraction is not achieved, resulting in an in increase in dryer ON-time.

Currently, a load imbalance during a washer spin cycle is most commonly detected using a mechanical switch that detects when the washer drum is displaced beyond a threshold value. Displacement of the tub results in activation of the switch and the machine is typically turned off. Other types of imbalance detection devices rely on shock sensors or motor characteristics to denote when an imbalance exists, such as monitoring the torque of the motor or monitoring currents and voltages to sense changes in the power being used. A sudden increase in torque or use in power means that an imbalance has occurred during the spin cycle. These types of devices are adequate to detect imbalances at slower speeds, but not at today's higher appliance speeds. Many times, a load that is well balanced at a low speed or at the commencement of the spin cycle, can become imbalanced at increased speeds. In addition, known load imbalance detection devices are only capable of detecting an imbalance after it has occurred and provides no prediction of an upcoming imbalance situation or countermeasures.

Accordingly, there is a need for a system and method for predicting rotational imbalance in a high speed device prior to the imbalance occurring. In addition, there is a need for a device that provides countermeasures to correct the imbalance after it is detected. Furthermore, other desirable features and characteristics of the present invention will become apparent from the subsequent detailed description of the invention and the appended claims, taken in conjunction with the accompanying drawings and this background of the invention.

BRIEF DESCRIPTION OF DRAWINGS

The present invention will hereinafter be described in conjunction with the following drawing figures, wherein like numerals denote like elements.

DETAILED DESCRIPTION OF THE INVENTION

The present invention provides a system and method for predicting rotational imbalance in a device. The system and method provides the ability to reliably predict rotational imbalance in a device, such as a washing machine, a tire balancing system, or any other system that includes rotating parts, and initiate countermeasures to alleviate the conditions, which if not corrected will result in the imbalance.

Figure 1:
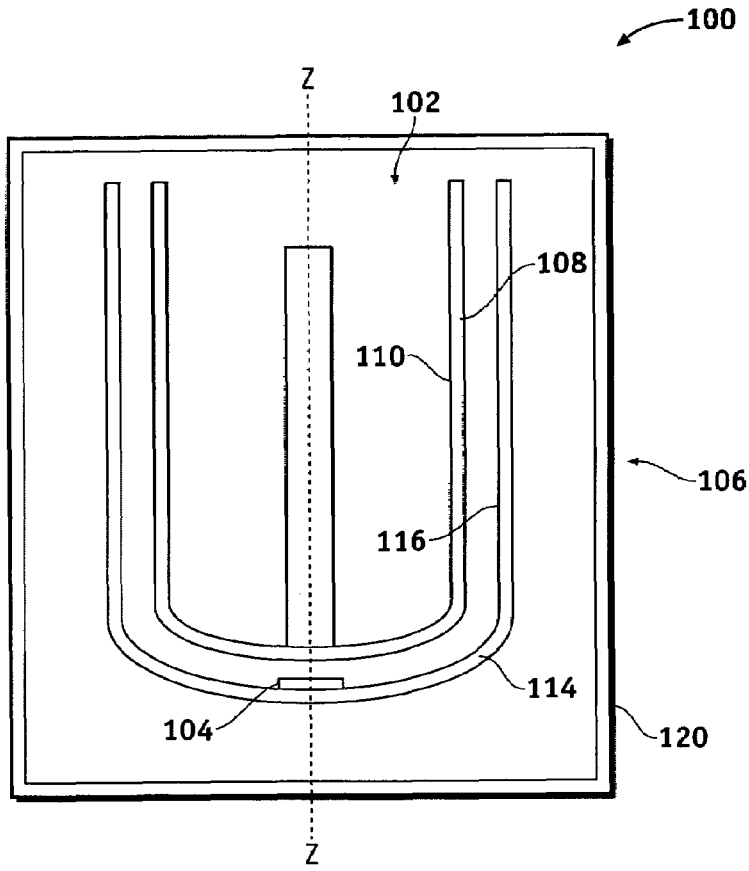
FIG. 1 is a side cross-sectional of a system for predicting rotational imbalance in accordance with the present invention.

Turning now to the drawings, FIG. 1 is a side cross-sectional view of a system 100 for predicting rotational imbalance according to an embodiment of the present invention. System 100 includes a rotating assembly 102 and an accelerometer assembly 104. Rotating assembly 102 in this particular embodiment is a portion of a washing machine 106. It should be clear, however, that the rotating assembly may be a portion of any type of device with respect to which a prediction of an imbalance condition in the rotating assembly is desired.

Washing machine 106 is comprised of an inner tub 108 defined by tub wall 110. Inner tub 108 rotates in a circular motion about a Z-axis, as indicated by dotted line Z-Z during operation of washing machine 106. Washing machine 106 further comprises an outer tub 114, defined by tub wall 116. Inner tub 108 is disposed within outer tub 114. During operation, inner tub 108 rotates at a high speed to extract water from wet clothing within tub 108. Water is extracted from the clothing due to centrifugal force during the spinning of inner tub 108. Outer tub 114 does not rotate but undergoes vibrational movement in response to the high speed rotation of inner tub 108.

Washing machine 106 further comprises an outer machine housing 120 in which inner tub 108 and outer tub 114 reside. In addition, although inner tub 108 is illustrated as rotating about a substantially vertical axis (i.e. in a top load washing machine), in an alternative embodiment (i.e. in a front load washing machine) inner tub 108 would rotate about a substantial horizontal axis. It should also be understood that the axis of rotation could have any value in between.

Accelerometer assembly 104 in this embodiment is mounted to the bottom of outer tub 114 and during operation rotates in an orbit caused by the rotation of inner tub 108. Accelerometer assembly 104 measures the vibration of outer tub 114 in response to the rotation of inner tub 108 for predicting an imbalance within inner tub 108. More specifically, accelerometer assembly 104 measures acceleration along two axes during vibration to determine acceleration vectors during a full orbit of inner tub 108.

During normal operation, inner tub 108 rotates in an orbit and accelerometer assembly 104, due to the vibration of outer tub 114, will also move about an orbital path. By determining the acceleration vectors during an entire orbit of inner tub 108, accelerometer assembly 104 provides data detailing the following: (i) the shape of the orbit of outer tub 114; (ii) rotational speed in RPM of outer tub 114; and (iii) the average radius of the orbit, extracted once the RPM is known. By comparing the average radius from one instant to the next, it is possible to determine if the average radius of the orbit is increasing during rotation. An increase in the average radius of the orbit of inner tub 108 makes it possible to predict a load imbalance.

Figure 2:
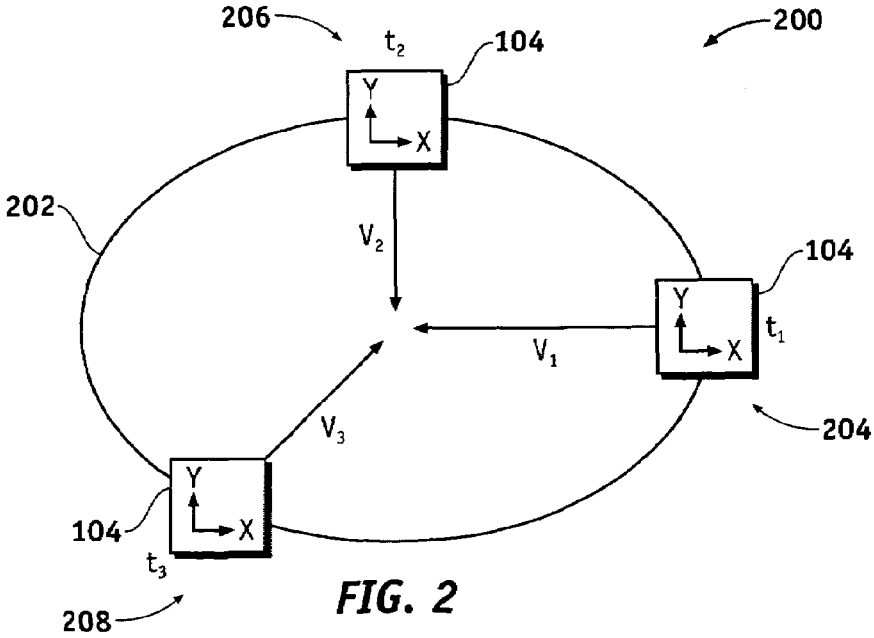
FIG. 2 is a diagram illustrating XY acceleration measurements and acceleration vectors of a system in accordance with the present invention.

FIG. 2 is a diagram 200 illustrating the XY acceleration measurements of accelerometer 104 over time and the centripetal acceleration vectors of the system in accordance with an embodiment of the invention. The movement of accelerometer assembly 104 on outer tub 114 is in an orbit 202. The positioning of accelerometer assembly 104 during orbit 202 is illustrated at times t1, t2, and t3 as inner tub 108 rotates counterclockwise. During operation, accelerometer assembly 104 will take a large number of readings at various times ($t_1$, $t_2$, $t_3$, etc.) during orbit 202.

A plurality of acceleration vectors ($v_1$, $v_2$ and $V_3$) seen by accelerometer assembly 104 are: (i) pointing toward the average center of rotational orbit 202 due to centripetal force; and (ii) of modulus $R_{avg}\omega^2$, where $R_{avg}$ is an average of the radius of orbit 202 and $\omega^2$ is the angular speed squared. In addition, $\omega=2\pi/T$, where T is the period of one orbit of accelerometer assembly 104.

Accelerometer assembly 104, and more particularly a plurality of accelerometers (described below), measures the X and Y components of the centripetal acceleration vectors $v_1$, $v_2$ and $V_3$. During orbit 202 described by the vibration of outer tub 114, accelerometer assembly 104 moves from a first position 204 at $t_1$, to a second position 206 at $t_2$. The accelerometers at position $t_1$ of orbit 202 will determine the acceleration vector $v_1$ as having a measure of acceleration in generally an negative X direction, with minimal acceleration in a Y direction. When accelerometer assembly 104 continues about orbit 202 to position 206 at $t_2$, the accelerometers will determine the acceleration vector $v_2$ as having a measure of acceleration in generally a negative Y direction with decreasing acceleration in the X direction. When accelerometer assembly 104 continues to rotate and reaches position 208 at $t_3$, the accelerometers will determine the acceleration vector $v_3$ as having a measure of acceleration in generally a positive Y direction and a positive X direction.

The average radius ($R_{avg}$) of orbit 202, which translates to the average radius of the orbit of inner tub 108 during rotation, is determined by measuring the average acceleration ($A_{avg}$) of orbit 202 described by outer tub 114 and calculating the average radius. The average radius of orbit 202 is determined by the formula: $R_{avg}=A_{avg}/\omega^2$. More specifically, the average radius of orbit 202 is determined by dividing the modulus of the acceleration (square root of $X^2+Y^2$) by $\omega^2$, where $\omega=2\pi/T$. When the average radius of orbit 202 is determined to be increasing, a prediction of an imbalance condition can be made.

Figure 3:
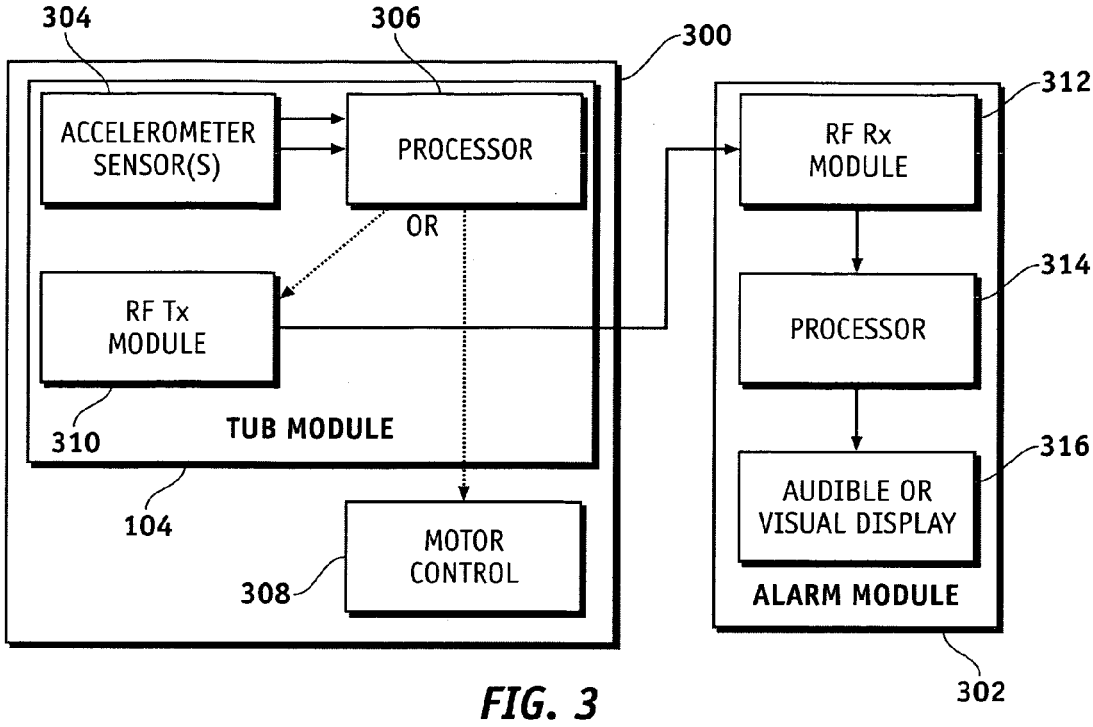
FIG. 3 is a block diagram for predicting rotational imbalance in accordance with the present invention.

FIG. 3 is a block diagram of the system 100 for predicting rotational imbalance of the present invention. System 100 includes a tub module 300 and an optional remote alarm module 302. Accelerometer assembly 104 of tub module 300 includes a plurality of accelerometers 304, a processor 306, such as a microprocessor, having inputs coupled to accelerometers 304, and outputs coupled to either a motor control 308 or an optional RF transmission module 310 for wirelessly transmitting a signal to remote alarm module 302. The plurality of accelerometers 304 provide acceleration measurements to processor 306, representative of the current acceleration in at least two directions of the rotating device it is connected to. In this embodiment, accelerometer assembly 104 is attached to outer tub 114 and is moving in an orbit (orbit 202 of FIG. 2) representative of the orbit of inner tub 108 of washing machine 106.

Accelerometers 304 monitor the rotational acceleration of orbit 202 of outer tub 114, and thus the rotational orbit of inner tub 108. Initially, software algorithms are encoded in processor 306 to receive the acceleration measurements and extract the RPM and geometric figures of merit, as described with respect to FIG. 2. Software will provide for recognition of an increase above a threshold value in the radius of the orbit of inner tub 108, thus predicting the out-of-balance condition.

Processor 306 determines if an increase in the average radius of the orbit of tub 108 is occurring beyond an allowable pre-determined amount and at what speed the increase is occurring. If so, processor 306 generates a signal that is transmitted by RF transmission module 310 to remote alarm module 302, or processor 306 generates a signal that is transmitted to motor control 308. Motor control 308 provides for pre-programmed countermeasures to take place and correct the foreseeable out-of-balance condition. Pre-programmed countermeasures can include the following: (i) slowing down the speed of the rotation of inner tube 108 to allow for redistribution of the clothing within inner tub 108; (ii) oscillating inner tub 108 back and forth to allow for redistribution of the clothing within inner tub 108; (iii) turning off washing machine 106, thereby stopping the rotation of inner tub 108; or (iv) similar measures to eliminate the predicted out of balance condition.

In the event remote monitoring is preferred, alarm module 302 is a remotely located monitoring unit or a portable receiving device that can be worn by a monitoring individual. Alarm module 302 comprises a RF receiver module 312 configured to receive wirelessly transmitted signals from accelerometers 304, and more particularly RF transmission module 310. A processor 314 in turn generates a signal for submission to an audible or visual display 316 alerting the monitoring individual of a predicted imbalance of machine 106. The monitoring individual will then initiate countermeasures to eliminate the upcoming imbalance condition.

A variety of different types of accelerometers can be used in the system and method described herein. One specific type of accelerometer that can be used is a micromachined accelerometer. For example, micromachined accelerometers can be used to accurately measure acceleration using changes in capacitance. Capacitive micromachined accelerometers offer high sensitivity with low noise and low power consumption and thus are ideal for many applications. In some embodiments, the accelerometers typically use surface micromachined capacitive sensing cells formed from semiconductor materials. Each cell includes two back-to-back capacitors with a center plate between the two outer plates. The center plate moves slightly in response to acceleration that is perpendicular to the plates. The movement of the center plate cause the distance between the plates to change. Because capacitance is proportional to the distance between plates, this change in distance between plates changes the capacitance of the two capacitors. This change in capacitance of the two capacitors is measured and used to determine the acceleration in the direction perpendicular to the plates, where the direction perpendicular to the plates is commonly referred to as the axis of the accelerometer.

Typically, micromachined accelerometers are packaged together with an application specific integrated circuit (ASIC) that measures the capacitance, extracts the acceleration data from the difference between the two capacitors in the cell, and provides a signal that is proportional to the acceleration. In this implementation, more than one accelerometer may be combined together in one package. For example, accelerometer assembly 104 includes two accelerometers, with each accelerometer configured to measure acceleration in a different orthogonal axis. The accelerometers are designed or packaged together with the ASIC used to measure and provide the acceleration signals in both directions. Other implementations are packaged with one accelerometer per device or three accelerometers per device. All of these implementations can be adapted for use in the system and method for predicting rotational imbalance.

One suitable accelerometer that can be adapted for use in the system and method is a dual axis accelerometer MMA6233Q available from FREESCALE SEMICONDUCTOR, INC. This accelerometer provides the advantage of measuring acceleration in two directions with a single package. Other suitable accelerometers include a triple-axis accelerometer MMA7260Q and single axis accelerometer MMA1260D. Of course, these are just some examples of the type of accelerometers that can be used in the system and method for predicting rotational imbalance.

Figure 4:
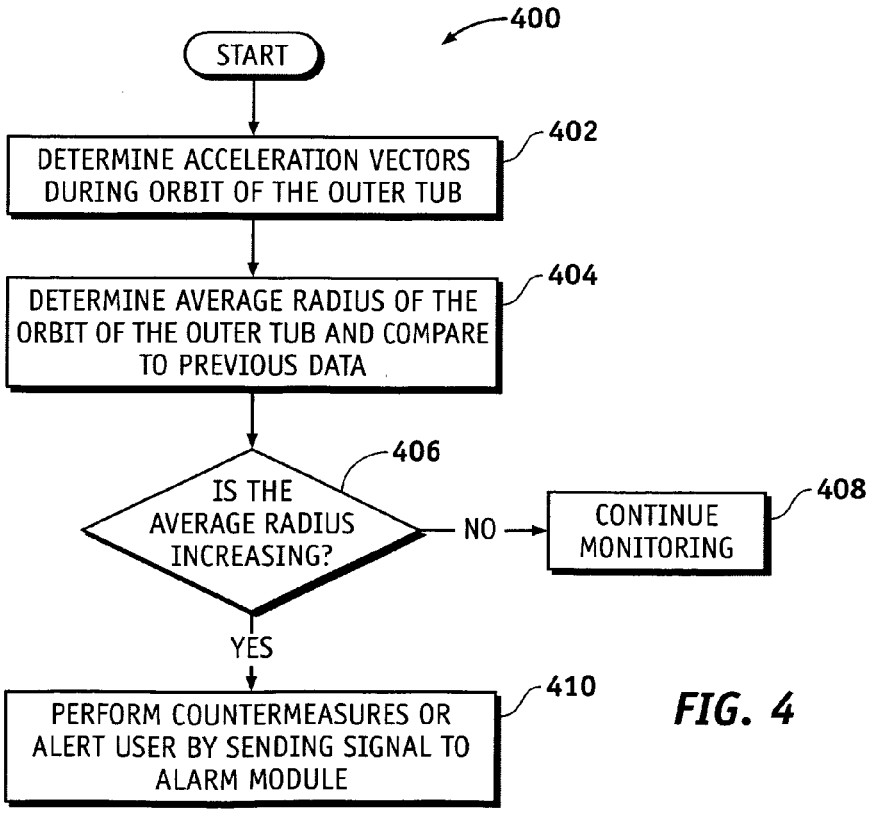
FIG. 4 is a flow diagram of a method for predicting rotational imbalance in accordance with the present invention.

FIG. 4 illustrates a method 400 of predicting a rotational imbalance in a rotating device according to the present invention. Method 400 provides for the ability to detect a rotational imbalance in an inner tub of a washing machine, such as inner tub 108 of washing machine 106 described in FIG. 1.

First, accelerometer measurement signals are received (402) and acceleration vectors during an orbit of the tub are determined. Typically the accelerometer measurement signals are provided by at least two accelerometers, where the at least two accelerometers are configured to measure acceleration in two orthogonal axes. Thus, there is at least one accelerometer measuring acceleration in an X-axis and at least one accelerometer measuring acceleration in a Y-axis, where X and Y are orthogonal axes. Different arrangements of accelerometers could be used in some embodiments. Acceleration measurements of accelerometer assembly 104 during the orbit described by outer tub 114 (FIG. 1) are received by processor 306 (FIG. 3).

With the accelerometer measurement signals received, the next step (404) is for processor 306 to determine the completion of a full orbit, calculate the RPM of outer tub 114, and calculate the average radius of the orbit of outer tub 114 and compare it to previous readings to determine if there is an increase in the average acceleration and average radius of the orbit (step 406). As will be described in detail below, one method of predicting if an imbalance condition is about to occur is to compare the measurement signals to previously received measurement signals. If the measurement signals for each axis indicate the average radius of the orbit is not increasing (step 408), then an imbalance occurrence is not predicted, and the system will continue to monitor the rotating inner tub (108). The method then returns to step 402 where data is continuously received and evaluated to determine if a rotational imbalance is predicted.

If the measurement signals for each axis indicate the average radius of the orbit is increasing (step 406), then an imbalance occurrence can be predicted. Upon prediction, an appropriate signal is generated by processor 306 (FIG. 3) and countermeasures can be taken (step 410), such as adjusting the tub rotation speed, rebalancing the load, or alerting the user if needed by sending a signal to the remote alarm module 302 (FIG. 3).

It should be noted that the steps in method 400 are merely exemplary, and that other combinations of steps or orders of steps can be used to provide for imbalance prediction.

Steps 402-410 of method 400 would be performed in real time, with the processor continually receiving measurement signals and determining if the measurements reflect an increase in the average radius of the orbit from previously received measurement signals. This can be accomplished by continually loading the measurements into an appropriate FIFO buffer and evaluating the contents of the buffer to determine if the criteria are met for each set of measurement signals, then loading the next set of measurements, and removing the oldest set of measurements.

The load imbalance prediction system can be implemented with a variety of different types and configurations of devices. As discussed above, the system is implemented with a processor that performs the computation and control functions of the system. The processor may comprise any suitable type of processing device, including single integrated circuits such as a processor, or combinations of devices working in cooperation to accomplish the functions of a processing unit. In addition, the processor may part of the electronic device's core system or a device separate to the core system. Furthermore, it should be noted that in some cases it will be desirable to integrate the processor functions with the accelerometers. For example, a suitable state machine or other control circuitry integrated with the accelerometers can implement the plurality of accelerometers and the processor in a single device solution.

The present invention thus provides for a system for predicting rotational imbalance of a rotating part. The system comprises at least one accelerometer responsive to the rotating part for sensing orbital movement of the rotating part and generating acceleration measurements representative of the orbital movement. The system further comprises a processor having inputs coupled to the at least one accelerometer for receiving the acceleration measurements and generating signals representative of the average radius of rotation, the processor analyzing the signals to detect an increase in said average radius to predict rotational imbalance in the rotating part. The processor further generates at least one control signal in response to a prediction of the rotational imbalance in the rotating part. In one embodiment, the processor may include an RF transmission module for transmitting the control signal to a remote alert module. In another embodiment, the processor transmits the control signal to a motor control, the motor control performing countermeasures in response to the prediction of a rotational imbalance. The rotating part is comprised of an inner tub and an outer tub, the inner tub configured for rotation about an axis. The at least one accelerometer is mounted to the outer tub, the outer tub vibrating in response to the rotational movement of the inner tub, the vibration of the outer tub describing the orbital movement of the inner tub. The at least one accelerometer measures acceleration of the outer tub in a plurality of directions and producing a plurality of acceleration measurements, including acceleration in a X direction and acceleration in a Y direction, where X and Y are perpendicular to each other. The processor receives the plurality of acceleration measurements from the at least one accelerometer, compares the plurality of acceleration measurements to a prior set of acceleration measurements of the outer tub and generates a rotational imbalance signal if the plurality of acceleration measurements predict a rotational imbalance condition. The processor determines if the average radius of rotation of orbit of the outer tub is increasing, predictive of a rotational imbalance condition, wherein the radius (R) of rotation is determined by calculating $R_{avg}=A_{avg}/\omega^2$, where A=acceleration, $\omega=2\pi/T$, and T=period of one full orbit.

The present invention further provides for a system for predicting rotational imbalance of a rotating part, the system comprising: a tub module comprising an inner tub configured for rotation about an axis, an outer tub, the inner tub disposed within the outer tub, the outer tub vibrating to describe an orbit in response to rotation of the inner tub, and an accelerometer assembly attached to the outer tub, the accelerometer assembly generating acceleration measurements representative of the orbit of the outer tub, a processor for calculating an average radius of the orbit of the outer tub and generating a signal in response to an increase in the average radius of the orbit of the outer tub to predict an imbalance condition. The accelerometer assembly includes at least one accelerometer providing a first acceleration measurement X and a second acceleration measurement Y. The system further includes a signal receiver comprising either a motor control or a remote alarm module, the signal receiver receiving the signal generated by the processor in response to a prediction of an imbalance condition. The motor control provides countermeasures in response to the prediction of an out of balance condition.

The present invention further provides for a method for predicting rotational imbalance of a rotating device, comprising measuring an average radius of a rotational orbit of the rotating device, detecting an increase in the average radius of the rotational orbit, and generating a signal in response to the increase in the average radius of the rotational orbit to predict an imbalance condition. The step of measuring an average radius of the rotational orbit of the rotating device includes measuring acceleration of the rotating device in a plurality of directions and producing a plurality of acceleration measurements. The plurality of acceleration measurements comprise first acceleration measurements X and second acceleration measurements Y. The plurality of acceleration measurements are received from at least one accelerometer. The step of detecting an increase in the average radius of the rotational orbit includes comparing a plurality of acceleration measurements to a prior set of acceleration measurements of the rotating part. The step of comparing the plurality of acceleration measurements to a prior set of acceleration measurements of the rotating part includes the step of determining if the average radius of the rotational orbit is increasing, predictive of a rotational imbalance condition, wherein the radius (R) of the orbit is determined by calculating $R_{avg}=A_{avg}/\omega^2$, where A=acceleration, $\omega=2\pi/T$, and T=period of one full orbit.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

The invention claimed is:

1. A system for predicting rotational imbalance of a rotating part, the system comprising:

at least one accelerometer responsive to the rotating part for sensing orbital movement of the rotating part and generating acceleration measurements representative of the orbital movement; and a processor having inputs coupled to the at least one accelerometer for receiving the acceleration measurements and generating signals representative of the average radius of the orbital movement, the processor analyzing the signals to detect an increase in said average radius to predict rotational imbalance in the rotating part, and generating at least one control signal in response to a prediction of the rotational imbalance in the rotating part.

2. A system for predicting rotational imbalance of a rotating part as claimed in claim 1 wherein the processor further includes an RF transmission module for transmitting the control signal to a remote alert module.

3. A system for predicting rotational imbalance in a rotating part as claimed in claim 1 wherein the processor transmits the control signal to a motor control, the motor control performing countermeasures in response to the prediction of a rotational imbalance.

4. A system for predicting rotational imbalance of a rotating part as claimed in claim 1 wherein the rotating part is comprised of an inner tub and an outer tub, the inner tub configured for rotation about an axis.

5. A system for predicting rotational imbalance of a rotating part as claimed in claim 4 wherein the at least one accelerometer is mounted to the outer tub, the outer tub vibrating in response to the rotational movement of the inner tub, the vibration of the outer tub describing the orbital movement of the inner tub.

6. A system for predicting rotational imbalance of a rotating part as claimed in claim 5 wherein the at least one accelerometer measures acceleration of the outer tub in a plurality of directions and producing a plurality of acceleration measurements.

7. A system for predicting rotational imbalance of a rotating part as claimed in claim 6 wherein the at least one accelerometer measures acceleration in a X direction and acceleration in a Y direction, where X and Y are perpendicular to each other.

8. A system for predicting rotational imbalance of a rotating part as claimed in claim 6 wherein the processor receives the plurality of acceleration measurements from the at least one accelerometer, compares the plurality of acceleration measurements to a prior set of acceleration measurements of the outer tub and generates a rotational imbalance signal if the plurality of acceleration measurements predict a rotational imbalance condition.

9. A system for predicting rotational imbalance of a rotating part as claimed in claim 4 wherein the processor determines if the average radius of rotation of orbit of the outer tub is increasing, predictive of a rotational imbalance condition, wherein the radius (R) of rotation is determined by calculating $R_{avg}=A_{avg}/\omega^2$, where A=acceleration, $\omega=2\pi/T$, and T=period of one full orbit.

10. A system for predicting rotational imbalance of a rotating part, the system comprising:

a tub module comprising:

an inner tub configured for rotation about an axis;

an outer tub, the inner tub disposed within the outer tub, the outer tub vibrating to describe an orbit in response to rotation of the inner tub;

an accelerometer assembly attached to the outer tub, the accelerometer assembly generating acceleration measurements representative of the orbit of the outer tub; and a processor for calculating an average radius of the orbit of the outer tub and generating a signal in response to an increase in the average radius of the orbit of the outer tub to predict an imbalance condition.

11. A system for predicting rotational imbalance in a rotating part as claimed in claim 10 wherein the accelerometer assembly includes at least one accelerometer providing a first acceleration measurement X and a second acceleration measurement Y.

12. A system for predicting rotational imbalance of a rotating part as claimed in claim 10 further including a signal receiver comprising one of a motor control or a remote alarm module, the signal receiver receiving the signal generated by the processor in response to a prediction of an imbalance condition.

13. A system for predicting rotational imbalance in a rotating part as claimed in claim 12 wherein the motor control provides countermeasures in response to the prediction of an out of balance condition.

14. A method for predicting rotational imbalance in a rotating part, the method comprising:

measuring an average radius of a rotational orbit of the rotating part;

comparing a plurality of acceleration measurements to a prior set of acceleration measurements of the rotating part to detect an increase in the average radius of the rotational orbit; and generating a signal in response to the increase in the average radius of the rotational orbit to predict an imbalance condition;

wherein the step of comparing the plurality of acceleration measurements to a prior set of acceleration measurements of the rotating part includes the step of determining if the average radius of the rotational orbit is increasing, predictive of a rotational imbalance condition, wherein the radius (R) of the orbit is determined by calculating $R_{avg}=A_{avg}/\omega^2$, where A=acceleration, $\omega=2\pi/T$, and T=period of one full orbit.

15. A method for predicting rotational imbalance of a rotating part as claimed in claim 14 wherein the step of measuring an average radius of the rotational orbit of the rotating device includes measuring acceleration of the rotating device in a plurality of directions and producing a plurality of acceleration measurements.

16. A method for predicting rotational imbalance of a rotating part as claimed in claim 15 wherein the plurality of acceleration measurements comprises first acceleration measurements X and second acceleration measurements Y.

17. A method for predicting rotational imbalance of a rotating part as claimed in claim 16 wherein the plurality of acceleration measurements are received from at least one accelerometer.

* * * * *